US009504880B2

(12) United States Patent
Bevier

(10) Patent No.: US 9,504,880 B2
(45) Date of Patent: Nov. 29, 2016

(54) FOOTBALL WITH AERODYNAMIC LACE

(71) Applicant: NIKE, Inc., Beaverton, OR (US)

(72) Inventor: Joseph J. Bevier, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/471,823

(22) Filed: Aug. 28, 2014

(65) Prior Publication Data

US 2015/0051031 A1 Feb. 19, 2015

Related U.S. Application Data

(62) Division of application No. 13/736,489, filed on Jan. 8, 2013, now Pat. No. 8,845,466, which is a division of application No. 12/421,980, filed on Apr. 10, 2009, now Pat. No. 8,371,971.

(51) Int. Cl.
*A63B 41/08* (2006.01)
*A63B 43/00* (2006.01)

(52) U.S. Cl.
CPC ..... *A63B 41/085* (2013.01); *A63B 43/00* (2013.01); *A63B 43/002* (2013.01); *A63B 2225/01* (2013.01); *A63B 2243/007* (2013.01)

(58) Field of Classification Search
CPC .... A63B 41/08; A63B 41/085; A63B 43/00; A63B 43/002; A63B 43/005; A63B 2225/01; A63B 2243/007
See application file for complete search history.

(56) References Cited

U.S. PATENT DOCUMENTS 1,449,209 A 3/1923 Zimmerman
1,559,117 A 10/1925 Maynard
1,931,429 A 10/1933 Buckner et al.
D92,721 S 7/1934 Jary
2,011,760 A * 8/1935 Gallinant ..... A63B 41/08 273/DIG. 25
2,182,053 A 12/1939 Reach
2,194,674 A 3/1940 Riddell
2,859,040 A 11/1958 Gow et al.
2,866,644 A 12/1958 Gow et al.
2,874,965 A 2/1959 Martin
2,906,533 A 9/1959 Gow et al.
2,931,653 A 4/1960 Gow et al.
4,736,948 A 4/1988 Thomas
4,772,020 A 9/1988 Martin
4,869,504 A 9/1989 Kralik
5,133,550 A 7/1992 Handy
5,195,745 A * 3/1993 Rudell ..... A63B 43/005 124/79
RE34,383 E 9/1993 Rohring
5,269,514 A 12/1993 Adler et al.
5,383,660 A 1/1995 Adler et al.
5,451,046 A 9/1995 Batton
5,480,144 A 1/1996 Downing
5,570,882 A * 11/1996 Horkan ..... A41D 19/01552 273/DIG. 30
5,577,724 A 11/1996 Gandolfo
5,669,838 A 9/1997 Kennedy et al.
5,779,576 A 7/1998 Smith, III et al.
D401,293 S * 11/1998 Alarid, Jr. ..... D21/712
D411,269 S 6/1999 Albarelli, Jr.
5,941,785 A 8/1999 Bartels
5,961,407 A 10/1999 Spiegel
5,997,422 A 12/1999 Cooper (Continued)

*Primary Examiner* — Steven Wong
(74) *Attorney, Agent, or Firm* — Quinn Law Group, PLLC

(57) ABSTRACT

Lace designs for footballs are provided. The laces have geometries that improve the aerodynamic characteristics of the football during flight. Additionally, the placement of the laces on the football is selected to maximize aerodynamic performance of the football during flight.

12 Claims, 11 Drawing Sheets

(56) References Cited

U.S. PATENT DOCUMENTS

| | | | | |
|---|---|---|---|---|
| 6,042,494 | A | 3/2000 | Rappaport et al. | |
| 6,612,948 | B1 | 9/2003 | Miller | |
| 6,767,300 | B2 | 7/2004 | Murphy et al. | |
| D505,462 | S * | 5/2005 | Horkan | D21/712 |
| 6,908,662 | B2 | 6/2005 | Pearce | |
| 7,470,203 | B1 | 12/2008 | Stillinger | |
| D639,360 | S | 6/2011 | Lederman et al. | |
| 8,152,664 | B2 * | 4/2012 | Madore | A63B 41/02 473/596 |
| 8,317,641 | B1 * | 11/2012 | Lowinger | A63B 43/02 473/597 |
| 8,371,971 | B2 | 2/2013 | Bevier | |
| 8,845,466 | B2 | 9/2014 | Bevier | |
| 9,089,744 | B2 * | 7/2015 | Lo | A63B 41/08 |
| 2006/0205544 | A1 | 9/2006 | Wyner et al. | |
| 2008/0108462 | A1 | 5/2008 | Krysiak | |
| 2014/0024483 | A1 | 1/2014 | Bevier | |

* cited by examiner

FOOTBALL WITH AERODYNAMIC LACE

CROSS-REFERENCE TO RELATED APPLICATION(S)

This application is a division of U.S. Pat. No. 8,845,466, currently co-pending application Ser. No. 13/736,489 filed on Jan. 8, 2013 and allowed on May 29, 2014, which is a division of U.S. Pat. No. 8,371,971, entitled "Football With Aerodynamic Lace", filed on Apr. 10, 2009, and allowed on Oct. 11, 2012, which application is hereby incorporated by reference in its entirety.

BACKGROUND

The present invention relates generally to a football with improved laces, and in particular to football having a lace that enhances the aerodynamics of the football.

Most inflatable sports balls are made by one of two main constructions: a traditional construction in which an inner bladder is surrounded by outer panels stitched together to contain the inflated bladder, and a carcass construction in which outer panels are laminated to an inner bladder. Examples of balls of traditional construction include some soccer balls, volleyballs, and footballs which have pieced and stitched outer panels. An example of a ball of carcass construction is a basketball which has an integral cover.

Conventional footballs are constructed in the traditional way by surrounding an inner bladder with an outer skin formed of multiple panels stitched together. In traditional construction, the bladder is inserted into an opening in the outer skin and the outer skin is laced together to close the opening.

This traditional lace is still used, even though modern manufacturing methods and materials do not necessarily require lacing together the outer skin of the football. Laces are provided mainly as a guide for proper finger placement or otherwise for gripping assistance. Different lace geometries and materials for improving the grip characteristics of a football have been proposed. See, for example, U.S. Pat. Nos. 5,779,576; 5,941,785; and 6,612,948.

The laces may also impact the aerodynamics of the football during flight. In particular, the laces may assist in reducing drag on the football and stabilizing the rotation of the football, which may allow a player to throw or kick a lace ball further or more accurately than an unlaced ball or a ball having traditional laces. However, the art has not explored the impact of laces on the aerodynamics of a football. Therefore, there exists a need in the art for different geometries of laces for footballs that improve the aerodynamic characteristics of the football.

SUMMARY

A football is provided with laces configured to enhance the aerodynamic performance of the football. The laces may have a number of different geometrical configurations. The laces may also be positioned on the football to enhance a pinwheel effect to stabilize the rotation of the football.

In one aspect, the invention provides a football comprising a body and a lace associated with the body, wherein the lace is configured to enhance an aerodynamic performance of the football.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION

Figure 1:
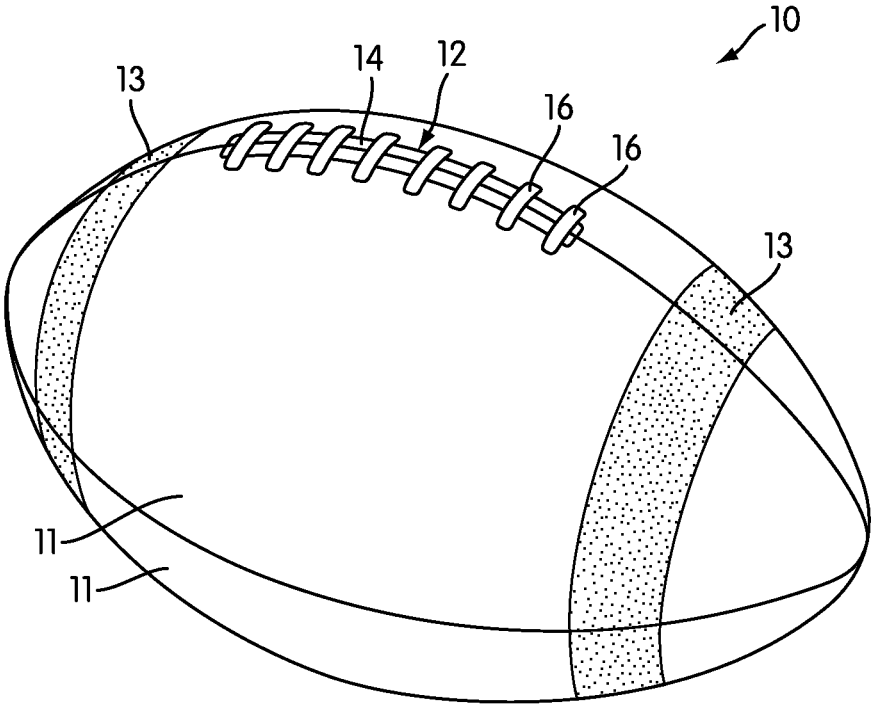
FIG. 1 PRIOR ART
FIG. 1 is a schematic perspective view of a prior art football having traditional laces.

Laces or lace elements on footballs are traditionally provided to close the outer skin of the football after insertion of an inflatable bladder and to provide a gripping guide for players. Such a traditional football 10 is shown in FIG. 1. Football 10 is generally a prolate spheroid body formed from multiple panels 11 that are stitched together. The bladder insertion opening is closed by a lace 12, and one or more markings 13 may be provided on football 10. Lace 12 traditionally includes a single piece of elongated material that is associated with football 10. Lace 12 forms a shape on the exterior of football 10 with a relatively long longitudinal portion 14 that is crossed by several relatively short transverse portions 16. Lace 12 typically protrudes from the surface of football 10. Players often utilize this traditional geometry for lace 12 to assist in proper finger placement when gripping football 10, such as in placing the fingers on football 10 in order to throw a long spiral. Throughout this description, it should be understood that the term "lace" is used to encompass traditional laces, a single molded element, or a plurality of molded elements provided on or formed with the football.

Figure 2:
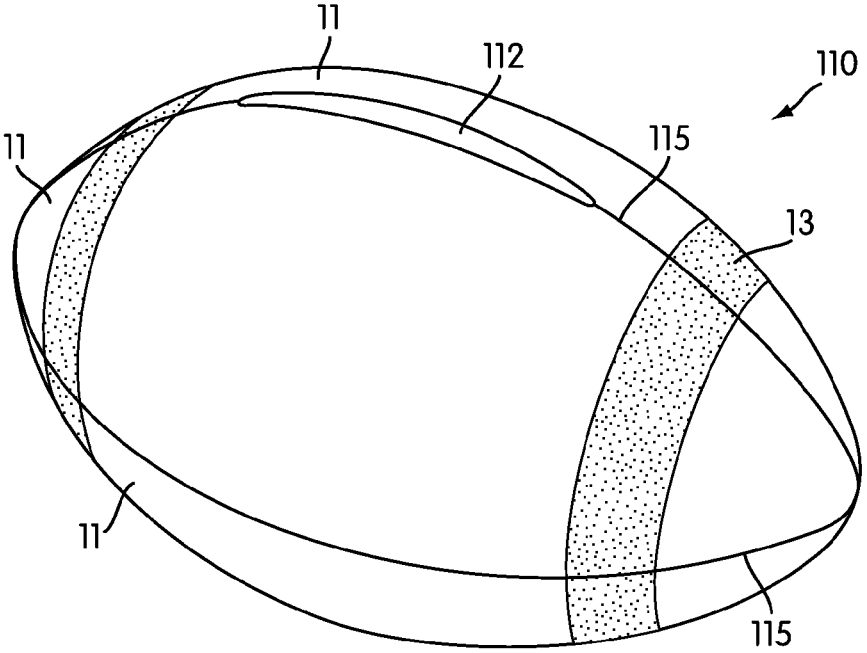
FIG. 2 is a schematic perspective view of a first embodiment of a football having aerodynamic laces.

FIG. 2 shows an embodiment of a first football 110 having a first lace 112 selected to improve the aerodynamic characteristics of first football 110 during flight. Similar to traditional football 10, first football 110 is generally a prolate spheroid. The body of first football 110 may generally be constructed with multiple panels 11 associated together at seams 115, such as by stitching, with an adhesive, or welding. In other embodiments, panels 11 may be associated together using other methods. In other embodiments, panels 11 may be defined on a unitary portion of material, such as by defining faux seam lines in a mold. In other embodiment, panels 11 may not be provided, and first football 110 may be formed from a single portion of material without defined seams.

Panels 11 may be made from any material known in the art for making sports balls. For example, panels 11 may be made from natural materials such as leather or rubber or synthetic materials such as plastics, synthetic rubber, or the like. Panels 11 may include texture, such as the inherent grain of leather or imparted texture, such as by providing pebbling, grooves, or other roughening structures onto the exterior surface of panels 11.

First aerodynamic lace 112 is a single molded element and generally has an elongated and tapered shape. The width of first aerodynamic lace 112 may vary along the length of lace 112. For example, as shown in FIG. 2, first aerodynamic lace 112 is broader in the center and tapered towards the ends. First aerodynamic lace 112 may also vary in height along its length. For example, as shown in FIG. 2, first aerodynamic lace 112 is higher in the center and tapers to a lower height at the ends. The variations in width and height along the length of first aerodynamic lace 112 may be smooth, as shown in FIG. 2, stepped, or undulating. While shown as having a smooth surface in FIG. 2, first aerodynamic lace 112 may also include surface texturing, such as pebbles, dimples, or the like.

In the embodiment shown in FIG. 2, first aerodynamic lace 112 is positioned along one of seams 115 and generally in between two adjacent panels 11. However, in other embodiments, first aerodynamic lace 112 may be positioned at other points on the exterior of first football 110. For example, first aerodynamic lace 112 may be positioned on a panel 11, or extend across multiple panels 11.

Figure 3:
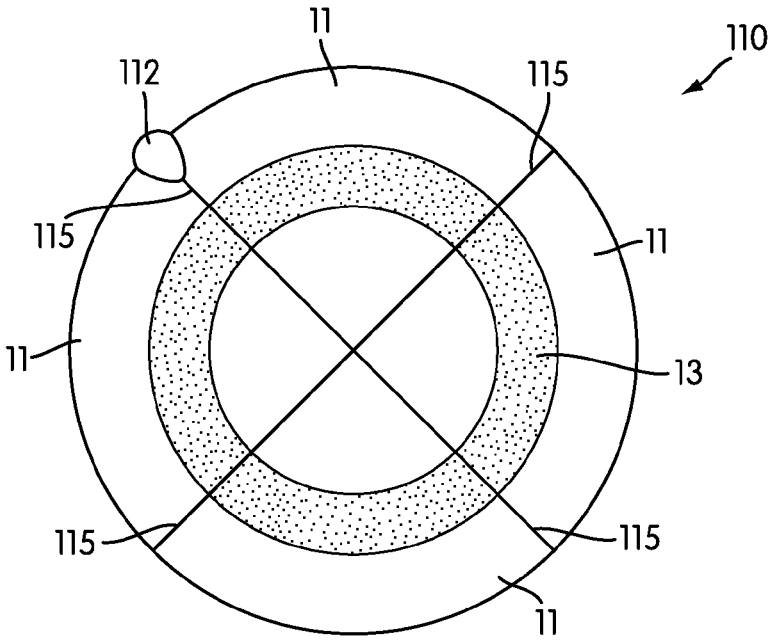
FIG. 3 is a schematic end view of the first embodiment of the football.

The aerodynamic laces may be made from any material known in the art, such as leather, natural or synthetic rubber, plastics, foams, textiles, or the like. The aerodynamic laces may be associated with a football using any method known in the art, such as by stitching, with an adhesive, co-molding, over-molding, welding, or the like. Aerodynamic laces may be associated with a football so that the aerodynamic lace protrudes from or forms a protrusion of an exterior surface of the football. FIG. 3 shows how first aerodynamic lace 112 may protrude from an exterior surface of first football 110. In other words, first aerodynamic lace 112 forms a "bump" on the surface of first football 110.

The protrusion or bump formed by first aerodynamic lace 112 alters the aerodynamic characteristics of first football 110 when compared with a football having a similar size and shape but either no laces or laces having a different geometry than first aerodynamic lace 112.

Any body moving through a fluid experiences a drag force, which may be divided into two components: frictional drag and pressure drag. Frictional drag is due to the friction between the fluid and the surfaces over which the fluid is flowing. The smoother the surface, the less frictional drag is generated by moving through the fluid.

Pressure or form drag derives from the eddying motions that are created by the motion of the body through the fluid, such as the formation of a region of separated flow or "wake" behind the body. The pressure in the wake is typically slightly less than the pressure in front of the body, and in extreme cases of cavitation, is significantly less than the pressure in front of the body. As such, to throw a ball further, the athlete or player must provide additional force to overcome the imbalance of the pressure forces in front of and behind the ball.

Because of the speeds at which footballs typically travel, the drag force on a football is generally dominated by the pressure drag component. The pressure drag depends on factors such as the density of the fluid through which the football is moving, the projected frontal area of the football, and the velocity of the football. This drag component is generally inflexible, given that the size of a football is typically proscribed by the rules of the game, the velocity of the football remains fairly constant for an athlete or player, and air density does not significantly vary.

With certain types of bluff bodies, such as spheres and cylinders, it has long been known that increasing surface roughness of the bluff body can actually reduce the pressure drag. For example, golf balls with dimples have significantly reduced drag and can travel much further than smooth surface golf balls. A sphere or cylinder with a roughened surface causes the laminar boundary layer to transition to a turbulent boundary layer at a lower velocity than that of a sphere or cylinder with a smooth surface. This turbulent boundary layer inhibits the separation of the fluid flowing around the body, causing the fluid to adhere to the surface contours of the body longer than the fluid would "stick" to a smooth body. As such, the cross-sectional area of the wake formed by the separation of the fluid flowing around the roughened body is smaller than the wake formed by the earlier separation of the same fluid flowing around a similarly-sized and shaped smooth body. For example, on a smooth sphere, using conventional notation with 0 degrees located at the leading edge of the sphere, the flow separation points are located at around 70 degrees and around 290 degrees on the sphere. On a roughened sphere, such as a golf ball with dimples, the turbulent boundary layer formed by the rough surface texture pushes the separation points toward 110 degrees and 250 degrees.

Figure 4:
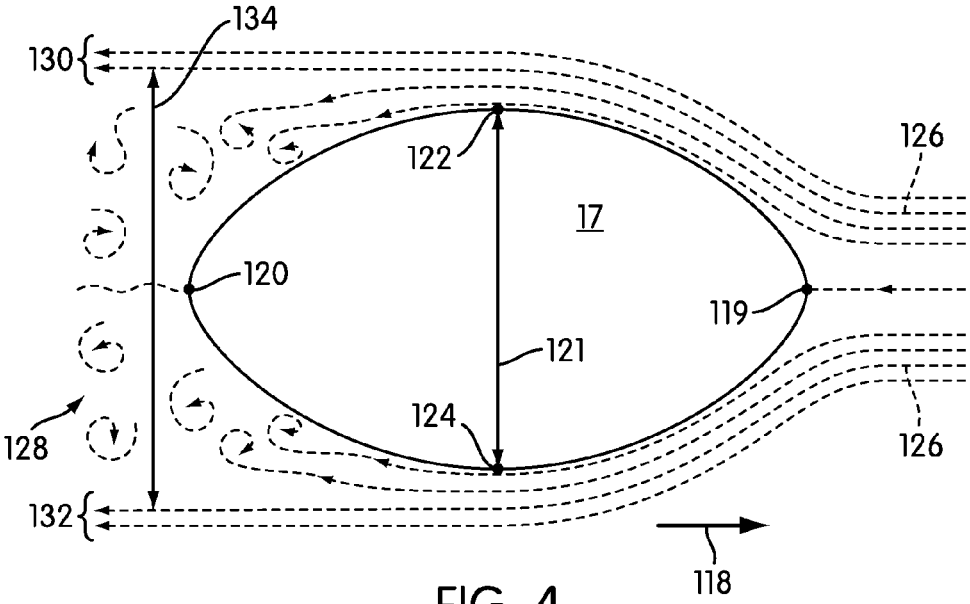
FIG. 4 is a schematic diagram of the air flow patterns around an unlaced football during flight.
Figure 5:
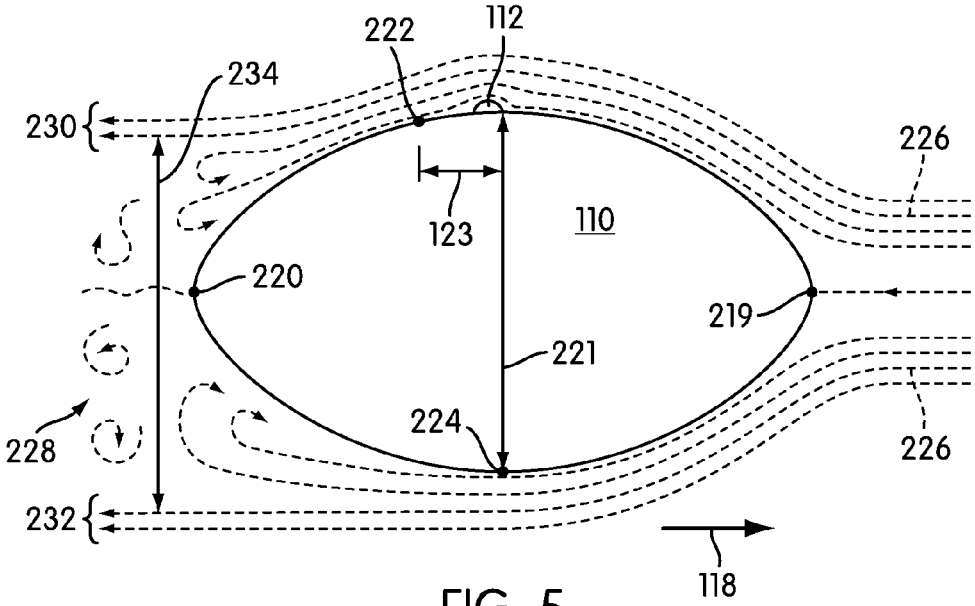
FIG. 5 is a schematic diagram of the air flow patterns around the first embodiment of a football having aerodynamic laces.

This effect is similar on a football provided with a lace. FIGS. 4 and 5 show the different flow patterns of air around a lace-free ball 17 and first ball 110. FIG. 4 shows the flow pattern around lace-free ball 17, which has a left-to-right travel direction 118. Lace-free ball 17 has a prolate spheroid shape, with a leading edge 119 at a first pointed end of lace-free ball 17 and a trailing edge 120 at the second pointed end of lace-free ball 17. The height of lace-free ball 17 approximately midway between leading edge 119 and trailing edge 120 is the small girth 121 of lace-free ball 17. Small girth 121 is the largest height of lace-free ball 17 between leading edge 119 and trailing edge 120.

As lace-free ball 17 moves through the air, the air flows around lace-free ball 17. The air can be considered to approach lace-free ball 17 near leading edge 119 as areas of laminar flow 126. The currents of air in laminar flow 126 before encountering leading edge of lace-free ball 17 are relatively evenly spaced apart and smooth. Once the currents of air encounter lace-free ball 17, the currents split and begin to flow around lace-free ball 17. Lace-free ball 17 is smoothly tapered, so the currents of air maintain laminar flow characteristics while generally following or "sticking" to the contours of the exterior of lace-free ball 17.

Eventually, however, the currents of air can no longer "stick" to the exterior surface of lace-free ball 17, and the currents transition to turbulent flow. The currents of air closest to the exterior surface of lace-free ball 17 separate from the exterior surface of lace-free ball 17 at a first separation point 122 and a second separation point 124. First separation point 122 and second separation point 124 are typically located at small girth 121 or shifted slightly toward trailing edge 120.

Beyond first and second separation points 122, 124, the currents of air that have separated from the exterior surface of lace-free ball 17 begin to exhibit turbulent flow characteristics and form a turbulent area or wake 128 beyond trailing edge 120. Wake 128 is bounded by areas of laminar flow, a first laminar flow 130 and a second laminar flow 132. The distance between first laminar flow 130 and second laminar flow 132 is the wake height 134. The cross-sectional shape of wake 128 is generally circular, so wake height 134 is the diameter of the wake circle. Therefore, wake height 134 establishes the area of wake 128. Because the turbulent flow within wake 128 has a lower pressure than laminar flow areas 126, 130, and 132, wake 128 causes pressure drag on lace-free ball 17. The amount of pressure drag is proportional to the area of wake 128.

FIG. 5 shows how adding a lace to a football can impact the aerodynamic characteristics of the flight of the football. FIG. 5 shows the flow pattern around first football 110, which, like lace-free ball 17, has a left-to-right travel direction 118. First football 110 has a prolate spheroid shape, with a leading edge 219 at a first pointed end of first football 110 and a trailing edge 220 at the second pointed end of first football 110. The height of first football 110 approximately midway between leading edge 219 and trailing edge 220 is the first small girth 221 of first football 110.

Similar to the discussion of the air flow around lace-free ball 17, the air can be considered to approach first football 110 near leading edge 219 as areas of laminar flow 226. The currents of air in laminar flow 226 before encountering leading edge 219 of first football 110 are relatively evenly spaced apart and smooth. Once the currents of air encounter first football 110, the currents split and begin to flow around first football 110. First football 110 is smoothly tapered, so the currents of air maintain laminar flow characteristics while generally following or "sticking" to the contours of the exterior of first football 110.

As discussed with respect to lace-free ball 17, the currents of air will reach a point where the currents can no longer "stick" to the exterior surface of first football 110. The currents of air closest to the exterior surface of first football 110 separate from the exterior surface of first football 110 at a first separation point 222 and a second separation point 224. Second separation point 224 is positioned similarly to the position of second separation point 124 on lace-free ball 17. However, prior to encountering first separation point 222, the air currents encounter lace 112, which is shown in this diagram as a simplified bump. Lace 112 trips the flow to prevent the transition from laminar to turbulent flow. Therefore, instead of separating from the exterior surface of first ball 110 near first small girth 221, the flow sticks to the exterior surface of first ball 110. First separation point 222 is shifted a first distance 123 toward trailing edge 220 as compared with first separation point 122 on lace-free ball 17.

As with lace-free ball 17, the currents of air that have separated from the exterior surface of first football 110 form a turbulent area or first wake 228 beyond trailing edge 220. First wake 228 is bounded by areas of laminar flow, a first laminar flow 230 and a second laminar flow 232 to establish first wake height 234. Because second separation point 222 is shifted toward trailing edge 220, first wake height 234 is shorter than wake height 134. Therefore, even though first wake 228 is an area of turbulent flow with lower pressure than laminar flow areas 226, 230, and 232, the area of first wake 228 is reduced as compared to the area of wake 128 for lace-free ball 17. Therefore, the amount of drag experienced by first football 110 is also reduced, due to the presence of lace 112.

The traditional lace design, as shown by lace 12 in FIG. 1, was not selected for aerodynamic considerations. Lace 12 was provided to securely close the skin of the ball after inserting the inner bladder. In testing, a football similar to first football 110 having a lace design like first aerodynamic lace 112 experienced 24.7% less drag than traditional laces like lace 12.

Figure 6:
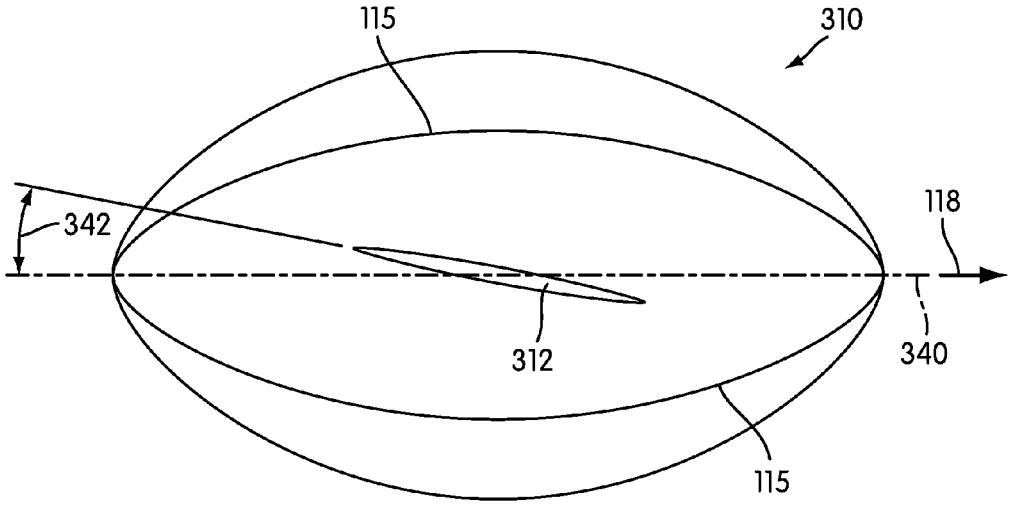
FIG. 6 is a schematic side view of a football having a second embodiment of aerodynamic laces.
Figure 7:
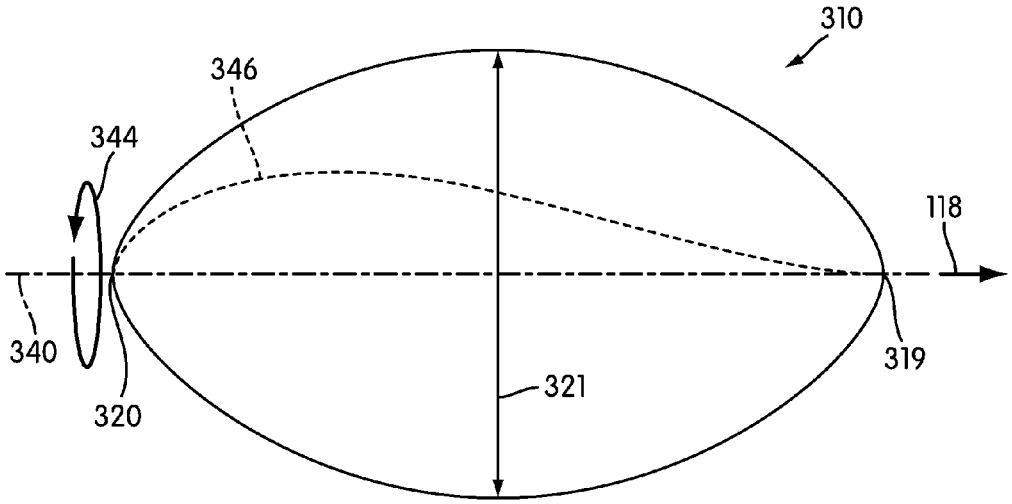
FIG. 7 is a schematic side view of the football shown in FIG. 6 with the lace removed to show certain air flow characteristics.
Figure 8:
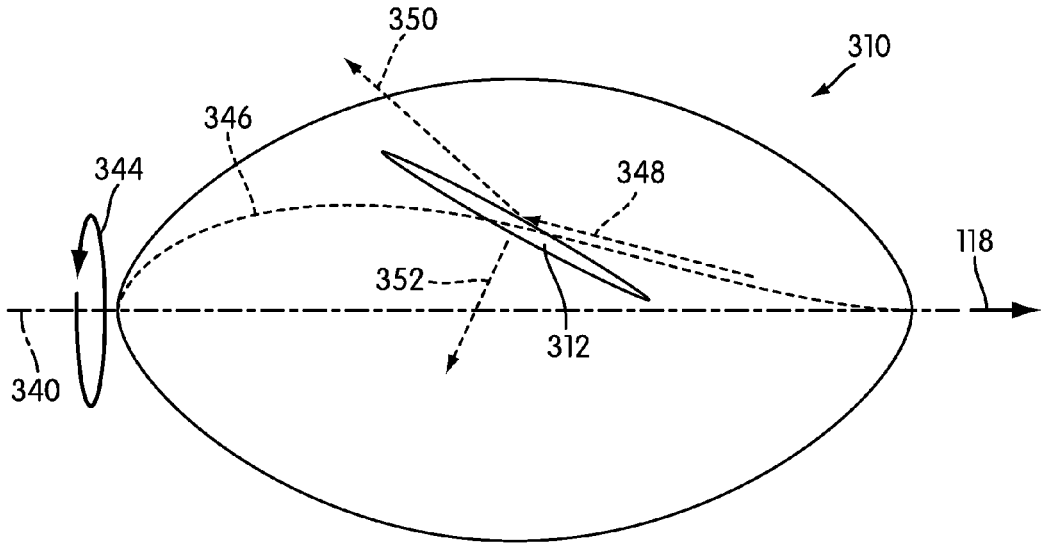
FIG. 8 is a schematic side view of the football shown in FIG. 6 showing forces on the football during flight.

In addition to the geometry or design of the lace of a football, the position of the lace on the football may also contribute to improved aerodynamic performance of the football. FIGS. 6-8 show how the placement of the lace on a football can impact aerodynamic performance. FIG. 6 shows a diagram of a second football 310 having a second aerodynamic lace 312 that is similar in size and shape with first lace 112. However, second aerodynamic lace 312 is not positioned on second football 310 so that second aerodynamic lace 312 aligns with a longitudinal axis 340 of second football 310 or a seam 115. Instead, second aerodynamic lace 312 is positioned at a first angle 342 to longitudinal axis 340.

As shown in FIG. 7, when spinning in a right-handed spin direction 344 about the longitudinal axis 340 when traveling in left-to-right travel direction 118, the flow of air over the surface of second football 310 assumes a helical path 346. Helical path 346 roughly has the shape of a hyperbolic curve on the surface of second football 310. The angle of helical path 346 is zero or substantially zero at or near a leading edge 319 and a trailing edge 320. The angle of helical path 346 is steepest at or near a small girth 321 or middle of second football 310. At typical throwing and rotational speeds of a good spiral throw, the steepest angle of helical path 346 is about 26 degrees or higher. Aligning second aerodynamic lace 312 with helical path 346 instead of longitudinal axis 340 or seam 115 reduces the effective cross-sectional area of second football 310 presented to the air flow or the aerodynamic cross-section. In other words, the effect of aligning second aerodynamic lace 312 with helical path 346 is similar to the aerodynamic impact of making second football 310 smaller by reducing the size of small girth 321.

Even though the angle of helical path 346 is about 26 degrees at small girth 321, first angle 342 may be selected to be lower than this steepest angle of helical path 346. The angle of helical path 346 is lower on either side of small girth 321, and second aerodynamic lace 312 stretches toward leading edge 319 and trailing edge 320 through these lower angles of helical path 346. In some embodiments, first angle 342, the angle formed by second aerodynamic lace 312 with longitudinal axis 340, ranges from about 10 degrees to about 25 degrees. In some embodiments, first angle 342 ranges from about 12 degrees to about 17 degrees. In a preferred embodiment, first angle 342 for a linear lace like second aerodynamic lace 312 is about 12 degrees.

The range of about 12 degrees to about 17 degrees for first angle 342 was initially determined by having a number of quarterbacks, ranging in age from eight (8) years to thirty-nine (39) years. The angle of the spiral of the rotating ball was measured for each throw. The mean average spiral angle was calculated to be about 17 degrees. Prior to testing the drag coefficient in a laboratory setting, therefore, the preferred angle for first angle 342 was anticipated to be about 17 degrees. Unexpectedly however, during drag coefficient testing, a football with a lace having a first angle of about 12 degrees produced the lowest drag coefficient.

Figure 19:
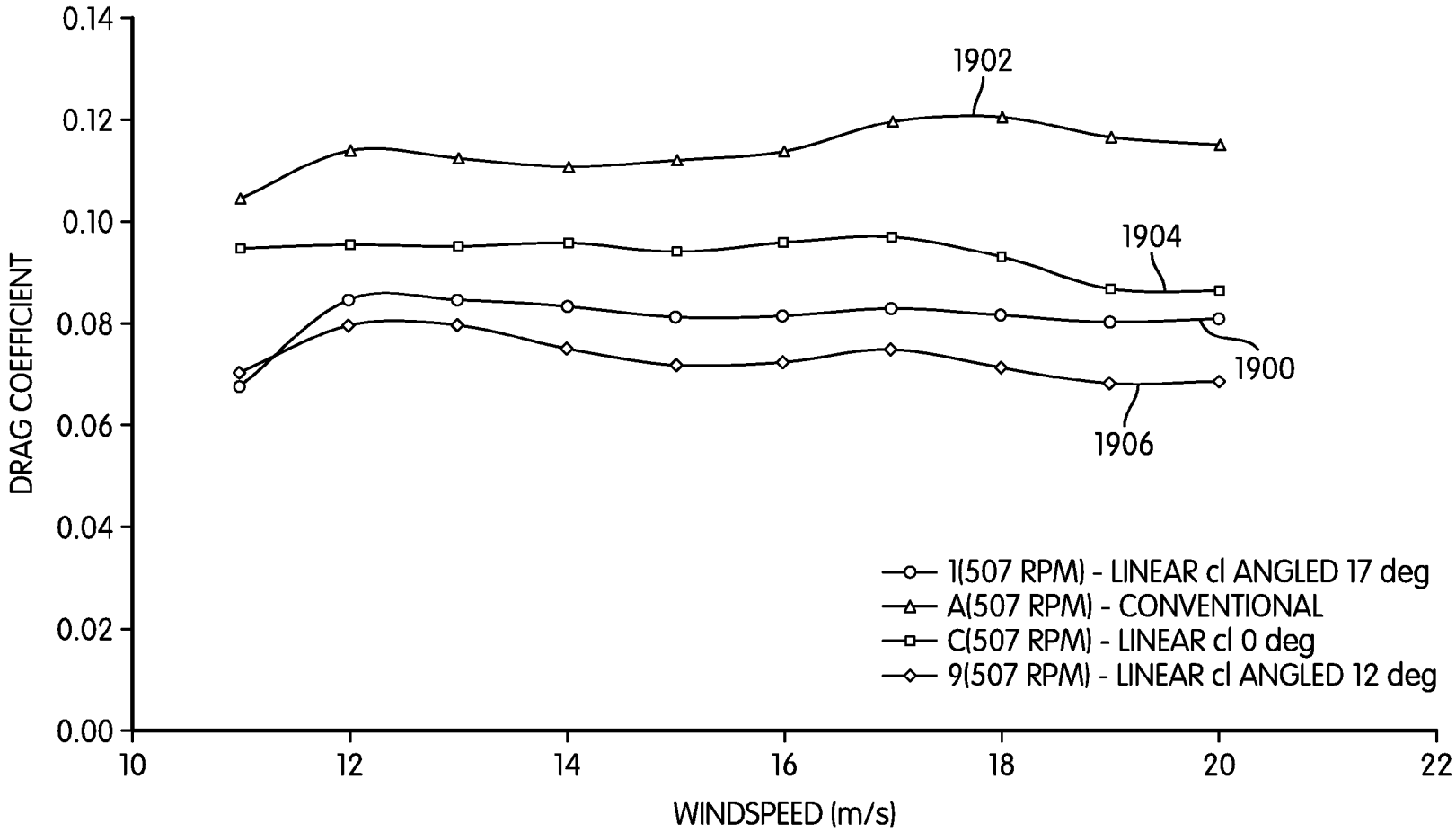
FIG. 19 is a graph showing drag coefficient versus windspeed for various lace configurations.

During drag coefficient testing, the drag coefficient versus windspeed was determined for various footballs mounted in a wind tunnel, where each football had a different lace configuration. A sampling of these test results is shown in FIG. 19. In FIG. 19, line 1902 shows the drag coefficient of a football with conventional laces. Line 1904 shows the drag coefficient of a football with an aerodynamic lace, similar to lace 312 shown in FIG. 8, but with a first angle of zero (0) degrees. Line 1900 shows the drag coefficient of a football with an aerodynamic lace, similar to lace 312 shown in FIG. 8, with a first angle of seventeen (17) degrees. Line 1906 shows the drag coefficient of a football with an aerodynamic lace, similar to lace 312 shown in FIG. 8, with a first angle of twelve (12) degrees.

While the football with a lace having a first angle of 17 degrees produced the lowest drag coefficient at windspeeds of less than about 11 meters per second, the football with a lace having a first angle 342 of about 12 degrees generally produced the lowest drag coefficient. The 17-degree first angle 342 for the lace is essentially a neutral angle of attack to the air flow over the ball, so the 17-degree first angle 342 lace exposes a minimal cross-sectional area to the air flow over the ball. However, the 12-degree first angle 342 for the lace is slightly oblique to the air flow over the ball. It is speculated that this slightly oblique angle allows the lace to act like a turbulator or vortex generator that trips the air flow to delay separation of the boundary layer as the air flows over the lace. This may reduce the base drag, which may provide the better drag performance of the 12-degree first angle 342 lace over the 17-degree first angle 342 lace. Because of these unexpected results from wind tunnel testing, a first angle 342 of about 12 degrees is preferred.

Selecting the position of a lace on the surface of a football can not only improve the aerodynamic characteristics by reducing drag, but can also help the football to retain its spin. This increases the stability of the throw, allowing the football to travel further and more accurately. This pinwheel effect is shown in FIG. 8. As second football 310 moves in left-to-right travel direction 118, second football 310 spins in right-hand spin direction 344 about longitudinal axis 340. Air approaches second aerodynamic lace 312 as a first current 348. First current 348 encounters second aerodynamic lace 312 at the angle of helical path 346 in the vicinity of second aerodynamic lace 312. Because second aerodynamic lace 312 is not positioned at the same angle as that of helical path 346 at the point at which first current 348 encounters second aerodynamic lace 312, a portion of first current 348 is deflected to form deflected air current 350. The force of this deflection pushes against second aerodynamic lace 312, similar to blowing on the blades of a pinwheel. Second aerodynamic lace 312 is pushed in a first direction 352, contributing to the spin of second football 310.

The geometry of aerodynamic laces are not limited to the linear lace shown in FIGS. 2-8. Because the aerodynamic laces are not restricted to conventional lacing materials, aerodynamic laces may have any geometry capable of being formed using any method known in the art. For example, an elongated portion of material may be sewn or adhered to a football in any number of patterns. Alternatively, lace elements having any of a myriad of shapes may be molded or otherwise formed and associated with a football in any number of configurations. In some embodiments, the lace element may be a continuous formation while in other embodiments, the lace element may be a series of discontinuous or spaced apart formations. This provides a designer the ability to finely tune the aerodynamic characteristics of a football by selecting a lacing system having a customized geometry and/or pattern. FIGS. 9-18 show various embodiments of aerodynamic laces for footballs.

Figure 9:
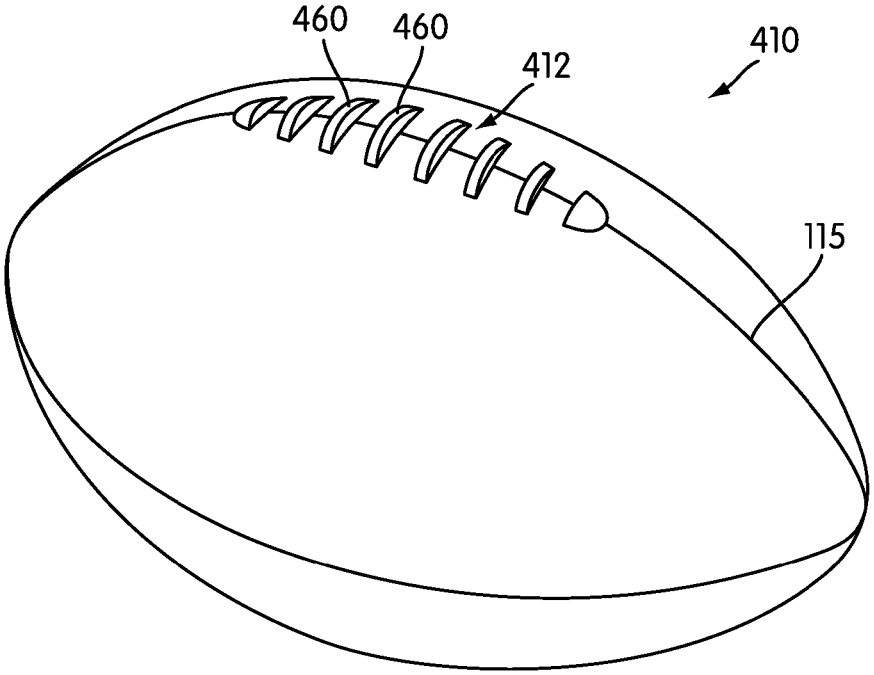
FIG. 9 is a schematic perspective view of a football with a third embodiment of aerodynamic laces.

FIG. 9 shows a third football 410 having a third aerodynamic lace 412. Third aerodynamic lace 412 includes a series of spaced-apart formations or projections 460 aligned with a seam 115 of third football 410. While eight projections 460 are shown in the embodiment pictured in FIG. 9, any number of projections 460 may be provided. In some embodiments, projections 460 may all have the same size and shape. In the embodiment shown in FIG. 9, projections 460 vary in height and shape. The center projections 460 have a partial disk-like shape. The center-most projections extend further away from the exterior surface of third football 410 than the rest of the projections. The height tapers toward the end projections, which have a tapered shape that is different from the shape of the center projections. A test football having a lace similar to third aerodynamic lace 412 showed 16.2% less drag than a football having traditional laces, like football 10 shown in FIG. 1.

Projections 460 may be made from any material known in the art that is capable of maintaining the shape of projections 460. For example, projections 460 may be made from a molded plastic or vinyl material. In some embodiments, projections 460 may be affixed directly to an exterior surface of third football 410, such as with an adhesive, co-molding, overmolding, or the like. In other embodiments, projections 460 may be attached to an inner surface of third football 410, such as the inner inflatable bladder (not shown) so that projections 460 protrude through the exterior skin of third football 410. In some embodiments, projections 460 may be spaced apart so that the exterior skin of third football 410 is visible in the interstitial spaces between projections 460.

Figure 10:
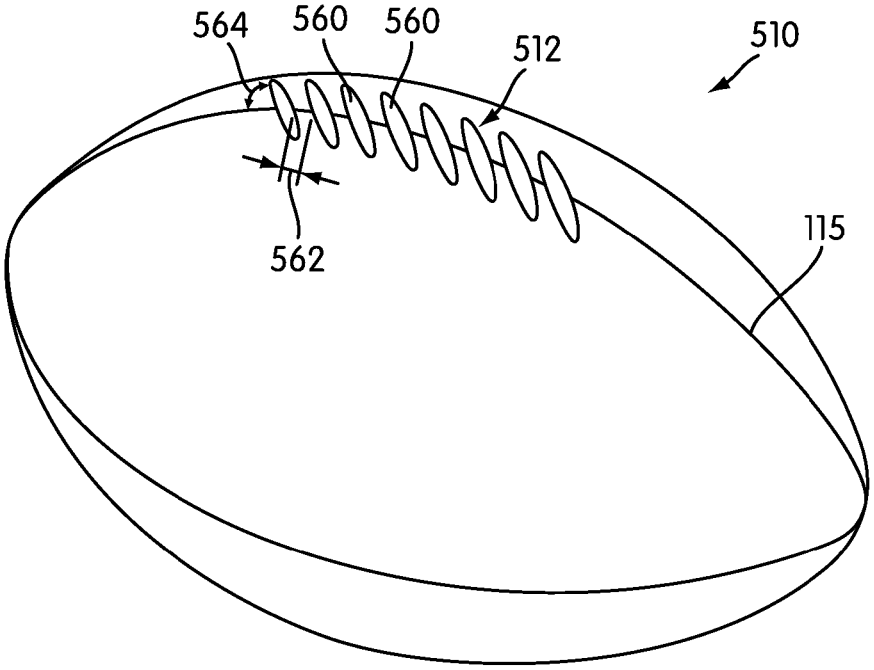
FIG. 10 is a schematic perspective view of a football with a fourth embodiment of aerodynamic laces.

FIG. 10 shows a fourth football 510 having a fourth aerodynamic lace 512. Fourth aerodynamic lace 512 includes a series of spaced-apart fourth projections 560 formed into a line that is aligned with a seam 115 of fourth football 510. Fourth projections 560 may be formed and associated with fourth football 510 in a similar fashion as described above with projections 460 and third football 410. In the embodiment shown in FIG. 10, fourth projections 560 all have approximately the same height and shape. Each fourth projection 560 has a rice-like, tapered shape that is placed on fourth football 510 at a projection angle 564 with respect to seam 115 and with an interstitial space 562.

A test football having a lace similar to fourth aerodynamic lace 512 showed 23.2% less drag than a football having traditional laces, like football 10 shown in FIG. 1.

Figure 11:
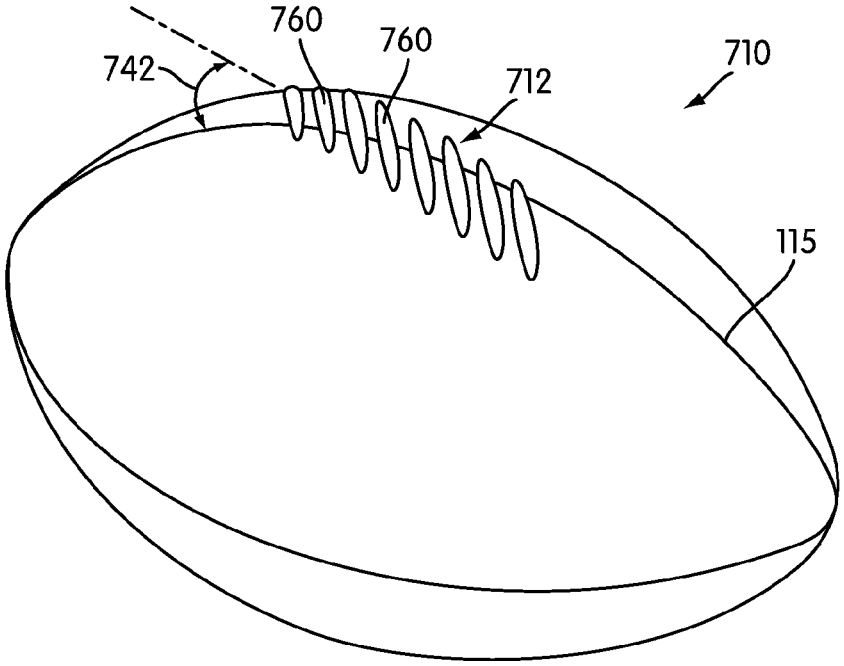
FIG. 11 is a schematic perspective view of a football having a fifth embodiment of aerodynamic laces.

FIG. 11 shows a fifth football 710 having a fifth aerodynamic lace 712. Fifth aerodynamic lace 712 is similar to fourth aerodynamic lace 512, in that a plurality of fifth projections 760 are provided. However, fifth projections 760 are arranged into a line 780 that forms a line angle 742 with respect to seam 115. In other words, line 780 crosses and is not parallel to seam 115. Line angle 742 may be selected to enhance or produce the pinwheel effect described above. Therefore, in some embodiments, line angle 742 may be selected to be the same as or similar to first angle 342, shown in FIG. 6. In such embodiments, line angle 742 may range from about 10 degrees to about 25 degrees, from about 12 degrees to about 17 degrees, or may be about 12 degrees.

Figure 12:
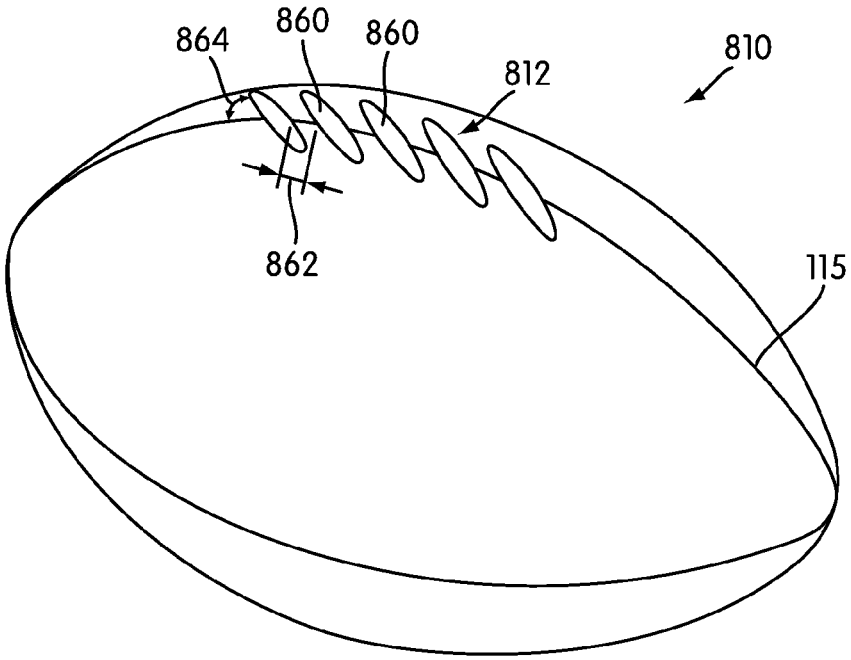
FIG. 12 is a schematic perspective view of a football having a sixth embodiment of aerodynamic laces.

FIG. 12 shows a sixth football 810 having a sixth aerodynamic lace 812. Sixth aerodynamic lace 812 is also similar to fourth aerodynamic lace 512. Sixth aerodynamic lace 812 includes a series of spaced-apart sixth projections 860 formed into a line that is aligned with a seam 115 of sixth football 810. However, sixth projections 860 are larger than fourth projections 560. Additionally, a sixth interstitial space 862 between sixth projections 860 is larger than the interstitial space 562 between fourth projections 560.

Figure 13:
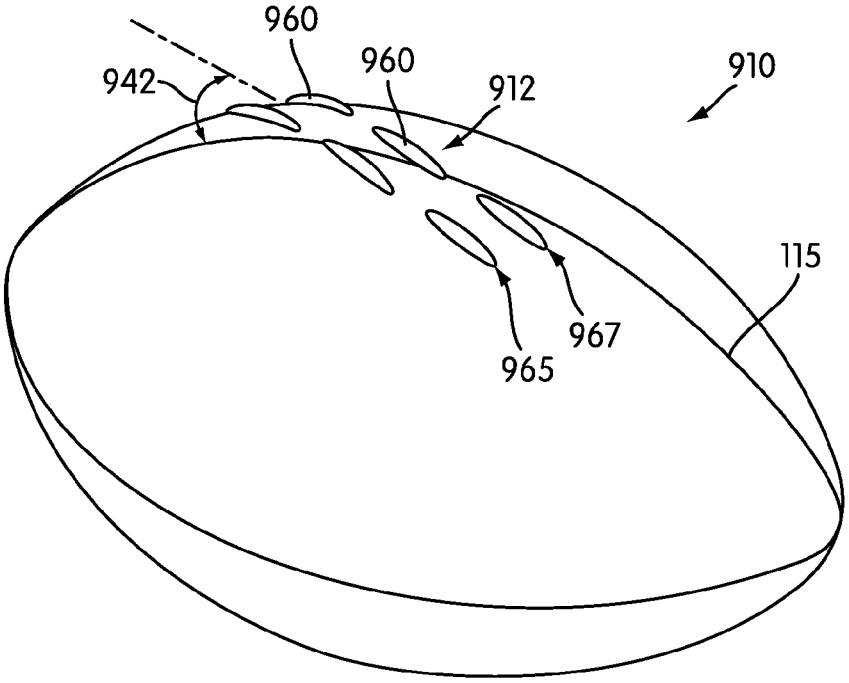
FIG. 13 is a schematic perspective view of a football having a seventh embodiment of aerodynamic laces.

FIG. 13 shows a seventh football 910 having a seventh aerodynamic lace 912. Seventh aerodynamic lace 912 includes a plurality of seventh projections 960. Seventh aerodynamic lace 912 forms a line 980 that is positioned at a seventh line angle 942 with respect to seam 115. Unlike earlier-discussed embodiments, seventh projections 960 are arranged into a first row 965 and a second row 967 on an exterior surface of seventh football 910. Each seventh projection 960 in first row 965 and second row 967 has a tapered, rice-like shape where the tapered ends of the projections are aligned, generally, with line 980.

Figure 14:
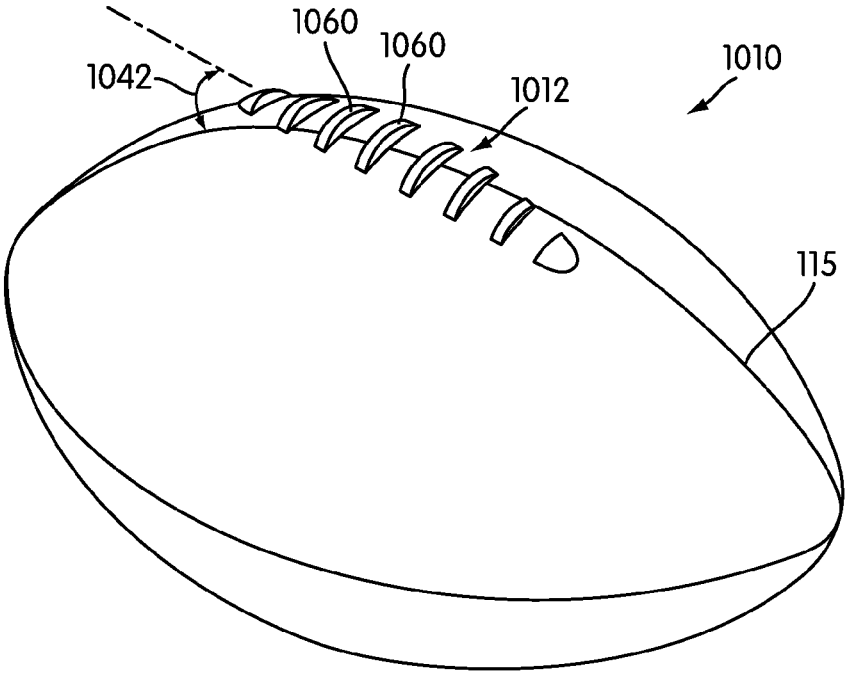
FIG. 14 is a schematic perspective view of a football having an eighth embodiment of aerodynamic laces.

FIG. 14 shows an eighth football 1010 having an eighth aerodynamic lace 1012. Eighth aerodynamic lace 1012 is similar to third aerodynamic lace 412, except that eighth projections 1060 of eighth aerodynamic lace 1012 are arranged into a line 1080 that forms an eighth line angle 1042 with respect to seam 115.

Figure 15:
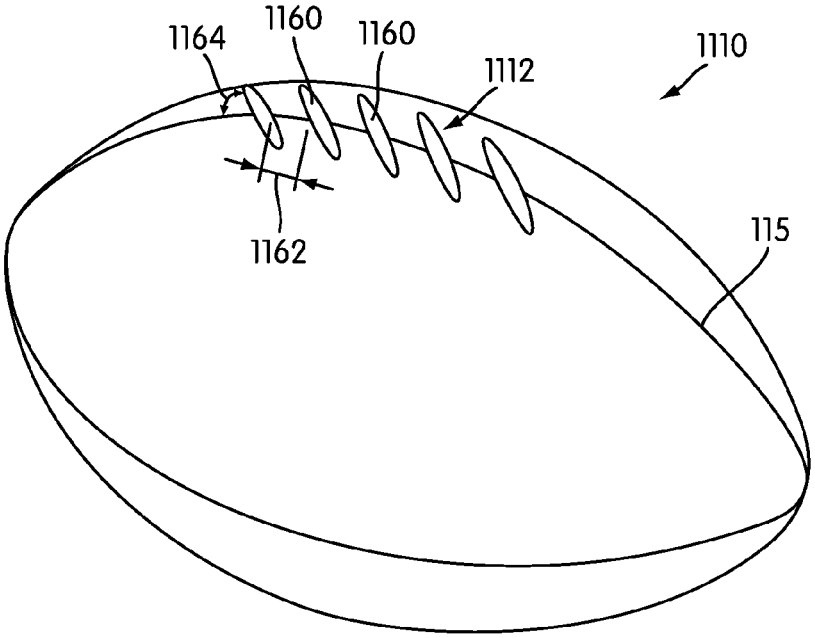
FIG. 15 is a schematic perspective view of a football having a ninth embodiment of aerodynamic laces.

FIG. 15 shows a ninth football 1110 having a ninth aerodynamic lace 1112. Ninth aerodynamic lace 1112 is similar to sixth aerodynamic lace 812, shown in FIG. 12. Ninth aerodynamic lace 1112 includes a series of spaced-apart ninth projections 1160 formed into a line that is aligned with a seam 115 of ninth football 1110, with each of ninth projections 1160 positioned at a ninth angle 1164 with respect to seam 115. However, ninth projections 1160 are thinner than sixth projections 860 so that a ninth interstitial space 1162 between ninth projections 1160 is larger than sixth interstitial space 862.

Figure 16:
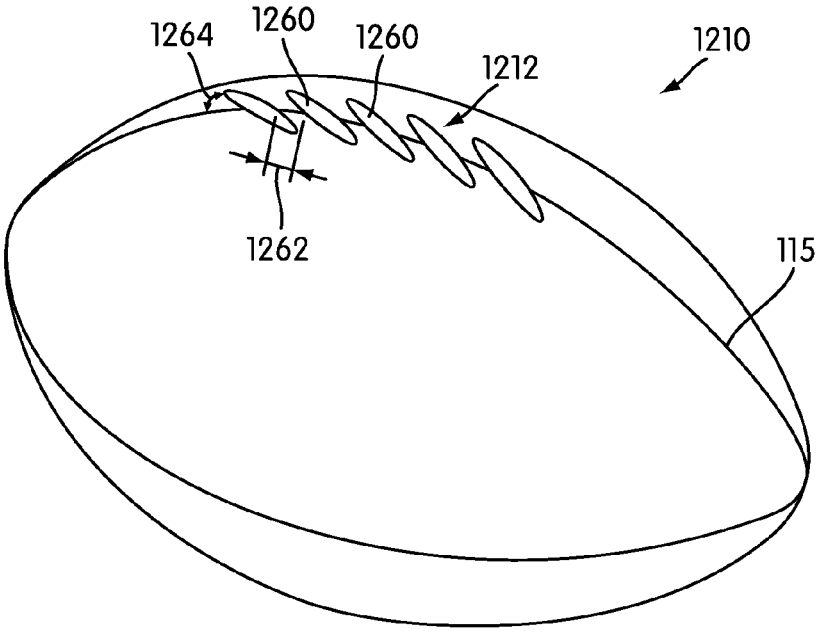
FIG. 16 is a schematic perspective view of a football having a tenth embodiment of aerodynamic laces.

FIG. 16 shows a tenth football 1210 having a tenth aerodynamic lace 1212. Tenth aerodynamic lace 1212 is similar to ninth aerodynamic lace 1112. Tenth aerodynamic lace 1212 includes a series of spaced-apart tenth projections 1160 formed into a line that is aligned with a seam 115 of tenth football 1210, with each of tenth projections 1160 is positioned at a tenth angle 1264 with respect to seam 115. Tent aerodynamic lace 1212 differs from ninth aerodynamic lace in that tenth angle 1264 is more acute than ninth angle 1164.

Figure 17:
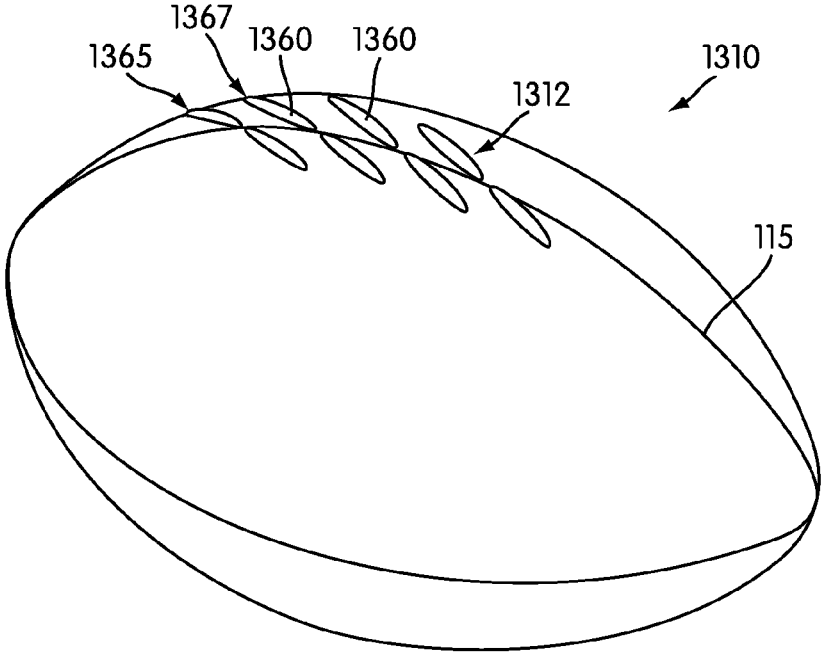
FIG. 17 is a schematic perspective view of a football having an eleventh embodiment of aerodynamic laces.

FIG. 17 shows an eleventh football 1310 having an eleventh aerodynamic lace 1312. Eleventh aerodynamic lace 1312 includes a plurality of eleventh projections 1160. Eleventh aerodynamic lace 1312 generally follows seam 115. Eleventh projections 1360 are arranged into a first row 1365 and a second row 1367 on an exterior surface of eleventh football 1310. Each eleventh projection 1360 in first row 1365 and second row 1367 has a tapered, rice-like shape where the tapered ends of the projections are angled with respect to seam 115.

Figure 18:
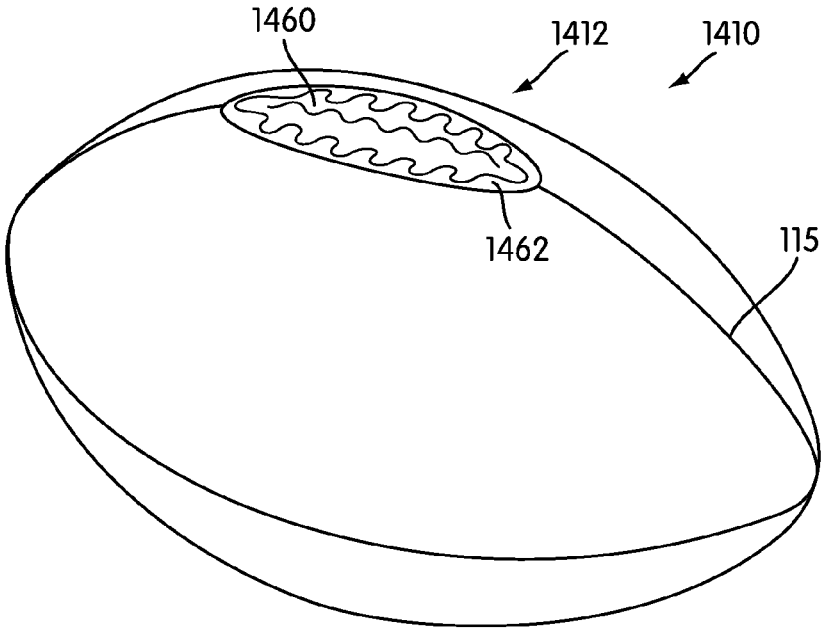
FIG. 18 is a schematic perspective view of a football having a twelfth embodiment of aerodynamic laces.

FIG. 18 shows a twelfth football 1410 having a twelfth aerodynamic lace 1412. Twelfth aerodynamic lace 1412 is generally a plate 1462 and projection 1460. Plate 1462 is configured to be associated with a surface of twelfth football 1410. Plate 1462 may be configured to lie flat against or to protrude from the exterior surface of twelfth football 1410. In some embodiments, a portion of plate 1462 may be inserted and/or secured underneath a skin of twelfth football 1410 so that another portion of plate 1462 is visible and/or protrudes from an exterior surface of twelfth football 1410. Projection 1460 may have any shape, including the shapes of the lace embodiments shown in the other figures or other shapes known in the art. Plate 1462 and projection 1460 may be made using any method known in the art, such as by molding, carving, or the like. Plate 1462 and projection 1460 may also be separately formed and associated together. In some embodiments, such as the embodiment shown in FIG. 18, plate 1462 and projection 1460 are aligned with seam 115. In other embodiments, either or both of plate 1462 and projection 1460 may be angled with respect to seam 115 to capture the pinwheel effect.

Although various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

The invention claimed is:

1. A football comprising:

a body; and a lace associated with the body, wherein the lace has a length associated with a longitudinal axis of the body and a width, the length being longer than the width;

wherein the length of the lace extends across the longitudinal axis at an angle less than 90 degrees with respect to the longitudinal axis;

wherein the lace has a center and two ends along the length, and wherein the width of the lace tapers from the center to the two ends;

wherein the lace is configured to enhance an aerodynamic performance of the football; and wherein the lace comprises a plurality of spaced-apart formations, and wherein each of the plurality of spaced-apart formations comprises an elongated formation having a length extending perpendicular to the length of the lace.

2. The football according to claim 1, wherein the plurality of elongated spaced-apart formations comprise at least one center-most projection, and wherein the at least one center-most projection extends further away from an exterior surface of the body than the remaining plurality of elongated spaced apart formations.

3. The football according to claim 1, wherein each of the plurality of spaced-apart formations has a height that varies above an exterior surface of the body along a length of each of the plurality of spaced-apart projections.

4. The football according to claim 3, wherein each of the plurality of spaced-apart formations has a center and two ends along its length, wherein the height of the center extends further away from the exterior surface of the body than the two ends.

5. The football according to claim 1, wherein the plurality of elongated spaced-apart formations form a plurality of interstitial spaces between the plurality of elongated spaced-apart formations, and wherein the body is visible in the plurality of interstitial spaces.

6. The football according to claim 1, wherein the lace is affixed directly to an exterior surface of the body.

7. The football according to claim 1, wherein the lace is attached to an interior surface of the football and configured to protrude through an exterior surface of the football.

8. The football according to claim 1, wherein the lace is co-molded with the football.

9. A football comprising:

a body defining a longitudinal axis;

a molded lace element associated with the body;

a lace axis defined along a center of the molded lace element between the furthest ends of the molded lace element;

wherein the molded lace element includes a plurality of elongated spaced-apart formations, and wherein each of the plurality of elongated spaced-apart formations has a length extending transverse to the longitudinal axis of the body;

wherein the lace axis of the molded lace element is oblique to the longitudinal axis of the body, such that the lace axis is orientated at a first angle of less than 90 degrees relative to the longitudinal axis of the body;

wherein the plurality of elongated spaced-apart formations form a plurality of interstitial spaces between the plurality of elongated spaced-apart formations, and wherein the body is visible in the plurality of interstitial spaces; and wherein the molded lace element is configured to enhance an aerodynamic performance of the football.

10. The football according to claim 9, wherein a height extending above the exterior surface of the body of each of the plurality of spaced-apart formations varies along the length of each of the plurality of spaced-apart formations.

11. The football according to claim 9, wherein the length of each of the plurality of elongated spaced-apart formations is perpendicular to the lace axis of the molded lace element.

12. The football according to claim 1, wherein the length of the lace extends across the longitudinal axis at an angle between 10 degrees to 25 degrees with respect to the longitudinal axis.

* * * * *